US011187196B2

(12) United States Patent
Wodausch et al.

(10) Patent No.: US 11,187,196 B2
(45) Date of Patent: Nov. 30, 2021

(54) TANK VENTING DEVICE FOR A FUEL TANK, AND VEHICLE

(71) Applicant: VOLKSWAGEN AKTIENGESELLSCHAFT, Wolfsburg (DE)

(72) Inventors: Jens Wodausch, Braunschweig (DE); Björn Fröhlich, Gifhorn (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/541,533

(22) Filed: Aug. 15, 2019

(65) Prior Publication Data

US 2020/0056567 A1 Feb. 20, 2020

(30) Foreign Application Priority Data

Aug. 15, 2018 (DE) ..... 10 2018 119 829.9

(51) Int. Cl.
*F02M 25/08* (2006.01)

(52) U.S. Cl.
CPC ..... *F02M 25/089* (2013.01); *F02M 25/0818* (2013.01); *F02M 25/0836* (2013.01); *F02M 25/0872* (2013.01); *F02M 2025/0845* (2013.01)

(58) Field of Classification Search
None
See application file for complete search history.

(56) References Cited

U.S. PATENT DOCUMENTS 8,590,514 B2 * 11/2013 Pursifull ..... F02D 41/0007 123/520
9,476,793 B2 * 10/2016 Takakura ..... G01M 3/2876
9,494,481 B2 * 11/2016 Takakura ..... F02M 25/0818
9,587,595 B2 * 3/2017 Woods ..... F02M 25/0836
9,644,552 B2 * 5/2017 Dudar ..... F02D 41/0032
9,689,349 B2 * 6/2017 Matsunaga ..... F02M 25/089
(Continued)

FOREIGN PATENT DOCUMENTS

DE 196 36 431 A1 3/1998
DE 196 39 116 A1 3/1998
(Continued)

OTHER PUBLICATIONS

Search report for German Patent Application No. 10 2018 119 829.9, dated Apr. 16, 2019.
(Continued)

*Primary Examiner* — Kevin R Steckbauer
(74) *Attorney, Agent, or Firm* — Pearl Cohen Zedek Latzer Baratz LLP

(57) ABSTRACT

A tank venting device for a fuel tank that supplies an internal combustion engine with a fuel includes a fuel vapor sorption system that is configured for reversibly storing fuel vapor in, and removing it from, the fuel tank, wherein the tank venting device includes at least one purge device, which is operable independently of the internal combustion engine, for applying a motive flow to the fuel vapor sorption system in the direction opposite from the fuel tank, so that the fuel vapor sorption system can be purged via a purge line, wherein the purge device includes at least one control device for controlling the motive flow.

9 Claims, 3 Drawing Sheets

(56) References Cited

U.S. PATENT DOCUMENTS 9,695,782 B2 * 7/2017 Tamura ..... F02M 25/0809
9,897,045 B2 * 2/2018 Makino ..... F02M 25/0836
9,970,393 B2 * 5/2018 Dudar ..... F01N 5/04
10,221,784 B2 * 3/2019 Pursifull ..... F02D 41/0042
10,352,260 B2 * 7/2019 Tochihara ..... F02D 41/22
10,480,431 B1 * 11/2019 Dudar ..... F02M 25/0854
10,677,200 B2 * 6/2020 Andrzejewski ..... F02D 41/0032
10,767,599 B2 * 9/2020 Dudar ..... F02D 41/0032
10,859,013 B2 * 12/2020 Asanuma ..... F02D 41/0042
2004/0129066 A1 * 7/2004 Schulz ..... F02M 25/0818 73/114.41
2006/0283427 A1 * 12/2006 Koyama ..... F02M 25/089 123/519
2009/0043476 A1 * 2/2009 Saito ..... B60W 10/30 701/102
2013/0319378 A1 * 12/2013 Haag ..... B60K 15/03504 123/519
2014/0277927 A1 9/2014 Guo
2014/0299111 A1 * 10/2014 Denz ..... F02M 35/10157 123/521
2015/0013437 A1 * 1/2015 Takakura ..... F02M 25/0818 73/40.5 R
2015/0040645 A1 * 2/2015 Takakura ..... G01M 3/025 73/47
2015/0159597 A1 * 6/2015 Woods ..... F02M 25/089 123/495
2015/0198123 A1 * 7/2015 Pearce ..... F02M 25/0809 123/520
2015/0275790 A1 * 10/2015 Matsunaga ..... F02M 25/0836 123/519
2015/0361929 A1 * 12/2015 Tamura ..... F02M 25/0809 73/114.39
2015/0369151 A1 * 12/2015 Dudar ..... F17C 5/02 141/4
2016/0000841 A1 3/2016 Dudar
2016/0258390 A1 * 9/2016 Makino ..... B60K 15/03504
2016/0290285 A1 * 10/2016 Dudar ..... F01N 5/04
2017/0152813 A1 * 6/2017 Casetti ..... G07C 5/0825
2017/0167415 A1 * 6/2017 Tochihara ..... F02M 25/0809
2017/0211430 A1 7/2017 Zschieschang
2017/0227017 A1 8/2017 Weigl
2018/0045128 A1 * 2/2018 Pursifull ..... F02D 41/0042
2018/0001641 A1 6/2018 Weddig et al.
2018/0164178 A1 * 6/2018 Weddig ..... F02M 25/0818
2019/0145354 A1 * 5/2019 Kato ..... F02M 35/1038 123/520
2019/0345885 A1 * 11/2019 Asanuma ..... F02M 25/0836
2019/0360412 A1 * 11/2019 Dudar ..... F02D 41/0045
2019/0360434 A1 * 11/2019 Dudar ..... F02D 41/0032
2020/0063671 A1 * 2/2020 Asanuma ..... B60K 6/46
2020/0095958 A1 * 3/2020 Teramoto ..... F02D 41/0037
2020/0102899 A1 * 4/2020 Andrzejewski ..... F02M 25/0872
2020/0232421 A1 * 7/2020 Huh ..... F02M 35/10222

FOREIGN PATENT DOCUMENTS

DE 100 19 905 A1 10/2001
DE 10 2010 064 239 A1 6/2012
DE 10 2011 086 946 A1 2/2013
DE 10 2013 109 459 A1 4/2014
DE 10 2014 222 241 B3 3/2016
DE 10 2016 010 837 A1 3/2018

OTHER PUBLICATIONS

Search Report of German Patent Application No. 10 2016 225 001.9, dated May 17, 2017.

* cited by examiner

TANK VENTING DEVICE FOR A FUEL TANK, AND VEHICLE

CROSS-REFERENCE TO RELATED APPLICATION

This application claims priority from German Patent Application No. 10 2018 119 829.9, filed Aug. 15, 2018, which is hereby incorporated by reference in its entirety.

FIELD OF THE INVENTION

The invention relates to a tank venting device for a fuel tank, and a vehicle.

BACKGROUND OF THE INVENTION

The fuel for operating internal combustion engines, which are used, for example, to drive the vehicle, is stored in fuel tanks. Evaporation of the fuel, in particular low-molecular hydrocarbons, occurs to a greater or lesser degree, depending on the outside temperature, the free liquid surface of the fuel, and other factors. These fuel vapors are usually collected in an activated carbon filter situated in a vent line of the tank. Since the loading capacity of activated carbon filters is limited, they must be purged with an air stream from time to time. It is understood that the purge air stream that is loaded with fuel vapors desorbed from the filter must not be emitted untreated to the environment. In this regard, it is known to supply the purge air stream to the internal combustion engine in order to combust the hydrocarbons, contained in the purge air stream, in the engine.

Recent exhaust gas emission limits require higher purge air rates from the tank venting. This is achieved by using tank venting designs having two introduction points, i.e., one introduction point in the intake manifold and another introduction point upstream from the compressor. The introduction point upstream from the compressor is currently designed with intensifying elements, for example using a Venturi nozzle. The Venturi nozzle acquires its intensifying potential via the pressure difference between the pressure upstream and downstream from the compressor. The motive flow of the Venturi nozzle that is generated by this pressure difference represents a leak over the length of the compressor, and thus has an adverse effect on the height reserve of the compressor. In addition, the purge potential of the Venturi nozzle is physically limited. For this reason, the Venturi nozzle is designed conservatively to ensure a sufficient height reserve of the exhaust gas turbocharger. The motive flow results from the pressure delta that develops. If the Venturi principle is used to increase the purge air quantity, there is no control of the motive flow. As a result, the potential with regard to the purge air quantity that is to be conveyed is wasted. This disadvantage is addressed, for example, by compromise parameterization of the tank venting, taking the height reserve of the exhaust gas turbocharger into account. Further alternative designs are also known from the prior art.

A tank venting device is known from DE 10 2013 109 459 A1. The presented tank venting device is designed for an internal combustion engine having a motor vehicle tank device. Fuel vapors exiting from a fuel tank are collected and temporarily stored in an adsorption container, wherein a pump generates a purge air stream through the adsorption container, and a tank vent valve meters the air stream as a function of the operating state of the internal combustion engine. The pump has a first and a second conveying direction. An additional control device for controlling the purge air stream, beyond a function of the pump, is not provided.

An electrically driven pump is presented in the publication DE 10 2014 222 241 B3. The presented pump is suitable for use in a fuel tank system as a purge air pump in order to appropriately draw out gases or gas mixtures in such a system. An additional control device for controlling the purge air stream, beyond a function of the pump, is not provided.

Furthermore, a tank venting device for a motor vehicle and a method for operating such a tank venting device are known from DE 10 2016 010 837 A1. A heating device for heating the filter material, an additional container, and a pump that is different from that used in the internal combustion engine are provided in addition to a vent line for conducting a gas that contains a fuel component from a tank into an adsorption filter. The pump is provided for conveying the fuel components from the adsorption filter into the container. An additional control device for controlling the purge air stream, beyond a function of the pump, is not provided.

As stated above, the use of a Venturi nozzle as an intensifying element for a purge air mass flow that is introduced upstream from a compressor, for example, is assumed to be publicly known. However, it is disadvantageous that need-based control of the motive flow, for example with regard to an engine operating point and with regard to environmental conditions, is not possible. In addition, control with an external pump is either not possible at all, or possible only to a very limited extent.

SUMMARY OF THE INVENTION

The object of the invention is to provide a tank venting device that ensures regulatable, efficient purging.

In one preferred embodiment of the invention, a tank venting device for a fuel tank that supplies an internal combustion engine with a fuel is provided, comprising a fuel vapor sorption system that is configured for reversibly storing fuel vapor in, and removing it from, the fuel tank, wherein the tank venting device includes at least one purge device, which is operable independently of the internal combustion engine, for applying a motive flow to the fuel vapor sorption system in the direction opposite from the fuel tank, so that the fuel vapor sorption system can be purged via a purge line, wherein the purge device includes at least one control device for controlling the motive flow.

It is thus possible not only to ensure purging, but also at the same time, to apply a regulatable or controllable motive flow. In other words, a combination of conventional tank venting with an active purge device, which may also be referred to as an active purge element, and a control device is presented. A purge device that is to be operated autonomously allows an operator to apply a negative pressure in the tank venting device, so that this negative pressure is correspondingly the driving force for a purging operation in the vehicle in which the tank venting device is installed. In other words, the purge device is decoupled from the engine operation and an optionally provided exhaust gas turbocharger operation. The purge device is thus externally driven, and replaces, for example, a Venturi nozzle that is otherwise provided. In addition, by means of the control device the associated motive flow may be freely regulated or controlled, so that, for example, a particular operating state of the vehicle and of the internal combustion engine may be appropriately taken into account in the regulation/control.

For example, a need-based control of the motive flow may be carried out, depending on the requirement of an engine operating point. The introduction point of the motive flow, the same as with a conventional tank venting device, may be situated in a corresponding intake manifold of an optionally provided air supply system. The use of an active purge device, i.e., a purge device that is to be controlled or operated separately from the remaining components, may thus, for example, supply an optimal regeneration portion of the combustion in each engine operating point. In the case that an exhaust gas turbocharger is provided in the system, the design of the exhaust gas turbocharger is not affected by the system configuration presented. In this regard, the presented tank venting device allows a very efficient operating method, since it is possible to provide optimal coordination with the other components due to the controllability of the motive flow to be applied. In addition, it is possible to dispense with at least one blocking means, for example in the form of a check valve, since the active purge device is correspondingly provided in this section of the tank venting device.

Furthermore, in another preferred embodiment of the invention a vehicle is provided that includes the following components:

- an internal combustion engine that is operable with a fuel;
- a fuel tank that is designed to supply the internal combustion engine with fuel;
- a fuel vapor sorption system;
- a tank venting device according to claims 1 through 9.

The above-mentioned advantages for the device similarly apply to the presented vehicle.

Further preferred embodiments of the invention result from the other features set forth in the subclaims.

In another preferred embodiment of the invention, it is provided that the control device includes at least one control valve. In this way, it is even more possible to provide an efficient and regulatable purge device.

Moreover, in another preferred embodiment of the invention it is provided that the at least one control valve is situated downstream from the purge device, relative to the applied motive flow. Reliable regulation is thus possible in a particularly satisfactory manner.

In addition, in another preferred embodiment of the invention, it is provided that the fuel vapor sorption system includes at least one tank vent valve, wherein the at least one tank vent valve is situated upstream from the purge device and/or upstream from the internal combustion engine, relative to the applied motive flow. It is thus possible to impose few requirements on a necessary installation space, so that construction effort is minimized. In addition, only a small outlay with regard to the provided components or the hardware in general is necessary for providing an efficient, regulatable tank venting device. For example, a Venturi nozzle is not needed, and an additional blocking means, for example in the form of a check valve, may be dispensed with at the location in question.

Furthermore, in another preferred embodiment of the invention, at least one Venturi nozzle is provided in parallel to the purge device, so that the motive flow to be applied in the tank venting device may be applied by means of the purge device and/or by means of the Venturi nozzle. In other words, a particularly reliable and thus efficient tank venting device may be provided, since a motive flow to be applied may be applied via two possible paths. A desired overall power may be correspondingly adjusted or controlled via the regulation of the purge device. Depending on the design of the Venturi nozzle, a minimum quantity of a motive flow may be provided, for example when the purge device is switched off. In this regard, the switching off of the purge device itself represents a type of control.

In addition, in another preferred embodiment of the invention, at least one blocking means is provided in each case downstream from the purge device and downstream from the Venturi nozzle, relative to the applied motive flow. It is thus possible to block a path of the motive flow, or to favor the respective other paths, in a targeted manner.

Furthermore, in another preferred embodiment of the invention it is provided that the blocking means is a check valve. Particularly simple and thus efficient regulation may be achieved in this way.

Moreover, in another preferred embodiment of the invention it is provided that the purge device includes at least one purge air pump. In contrast to the publicly known use of Venturi nozzles as an intensifying element of the purge air mass flow, which is introduced upstream from a compressor, for example, a need-based control of the motive flow, for example with regard to a particular engine operating point or with regard to corresponding environmental conditions, may be achieved with such a purge air pump. In contrast to a Venturi nozzle having a fixed design, a pump may be adjusted with regard to a desired power. Quantity metering of the purge air takes place via a control device situated downstream from the purge device or the purge element, or via a control valve provided at that location. Particularly efficient and regulatable purging is thus achievable in a particularly satisfactory manner.

Lastly, in another preferred embodiment of the invention it is provided that the purge air pump is electrically and/or mechanically operable. The above-mentioned advantages may thus be achieved even more satisfactorily.

Unless stated otherwise in the individual case, the various embodiments of the invention mentioned in the present patent application may advantageously be combined with one another.

BRIEF DESCRIPTION OF THE DRAWINGS

The invention is explained below in exemplary embodiments with reference to the associated drawings, which show the following.

DETAILED DESCRIPTION OF THE INVENTION

Figure 1:
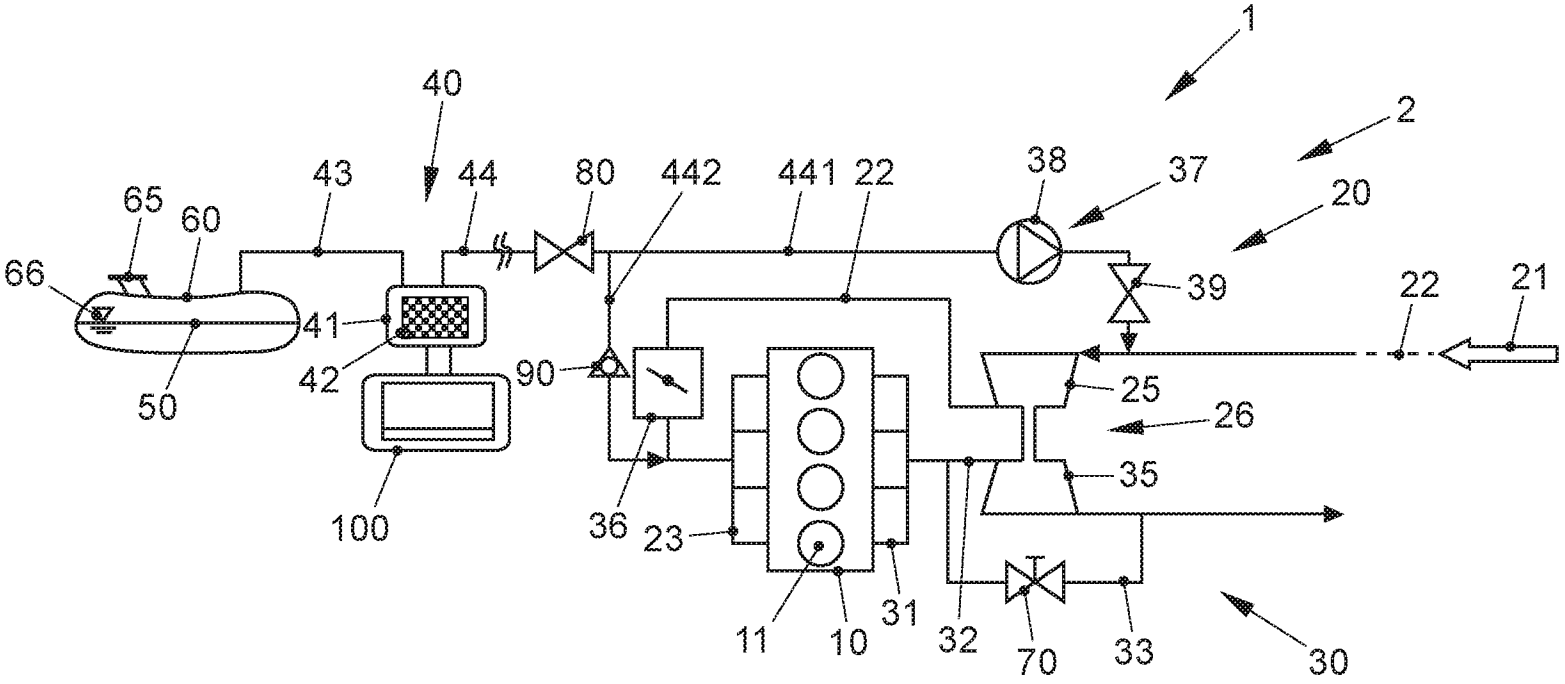
FIG. 1 shows a block diagram of a vehicle with a tank venting device according to the invention.

FIG. 1 shows a block diagram of a vehicle 1 having a tank venting device 2 according to the invention. FIG. 1 thus shows a vehicle, denoted overall by reference numeral 1, in which the presented tank venting device 2 is correspondingly accommodated. The vehicle 1 includes an internal combustion engine 10, an air supply system 20, an exhaust gas system 30, and a fuel vapor sorption system 40. Although a fuel supply system is not explicitly illustrated, it is understood that such a system is provided.

The internal combustion engine 10 includes at least one, in the present case four, for example, cylinders 11, and may be a (self-ignition) diesel engine or a (spark ignition) gasoline engine. In the present example, the engine is a gasoline engine in which ignition takes place by means of spark plugs.

The internal combustion engine 10 is operable with a fuel 50, in the present case gasoline. The fuel 50 is stored in a fuel tank 60 that may be filled via a filler neck 65, and that is equipped with a level sensor 66 for detecting the filling level. The fuel 50 is supplied to the internal combustion engine 10 via a fuel supply system, not shown in greater detail.

The combustion air 21 is supplied to the engine 10 by the air supply system 20, which draws in the air 21 from the surroundings and feeds it into the engine 10 via an intake line 22 and an air manifold 23, which distributes the air 21 to the cylinders 11. In the illustrated example, the combustion air 21 is compressed by a compressor 25 of an exhaust gas turbocharger 26 in order for the engine 10 to be operable at an increased charge pressure and thus with higher power. The compressor 25 is driven by a turbine 35, via a shaft, situated in the exhaust gas system 30. Situated in the intake line 22, downstream from the compressor 25, is an adjustable throttle valve 36 by means of which the cylinder charging is controllable or regulatable.

An exhaust gas of the internal combustion engine 10 is discharged via the exhaust gas system 30, and optionally undergoes catalytic aftertreatment. For this purpose, the exhaust gas system 30 includes an exhaust manifold 31 which collects the exhaust gases from the cylinders 11 of the engine 10 and conducts them into a shared exhaust duct 32. The above-mentioned turbine 35 of the exhaust gas turbocharger 26 is situated in the exhaust duct 32, so that the exhaust gas drives the turbine 35, and thus the compressor 25, with withdrawal of kinetic energy. The turbine 35 may be bypassed by means of a turbine bypass 33, wherein the portion of the exhaust gas that is led through the turbine bypass 33 is adjustable via an actuating means 70 that is situated in the turbine bypass 33 and that may be, for example, a wastegate or in general, an electrically actuated valve.

The fuel vapor sorption system 40 has a sorption agent container 41 in which a sorption agent 42 for sorption of fuel vapors, i.e., hydrocarbons, is present. In the present case, sorption is understood to mean any reversible binding, for example absorption, physical adsorption (physisorption), and/or chemical adsorption (chemisorption). The sorption agent 42 is preferably activated carbon, in particular an activated carbon filter, that binds fuel vapors by physical adsorption. In this regard, the sorption agent container 41 may also be referred to as an activated carbon container. The sorption agent container 41 is connected to the fuel tank 60 via a fuel vapor line 43. A purge line 44 branches off from the sorption agent container 41 and is divided into a first partial purge line 441 and a second partial purge line 442.

A purge device 37 is situated in the partial purge line 441. In addition, a control device 39 associated with the purge device is illustrated in front of the purge device 37 and in the present example, downstream from the purge device 37; in the present case the control device is illustrated as a control valve. The purge device 37 also includes a purge air pump 38.

The first partial purge line 441 opens into the intake line 22 via the suction side of the purge device 37. Downstream from the throttle valve 36, the second partial purge line 442 opens into the intake line 22 or directly into the air manifold 23. A tank vent valve 80 for adjusting, in particular limiting, the volume flow in the purge line 44 is situated in the shared section of the purge line 44. For example, the tank vent valve 80 may be designed as a valve that is controllable via an electric motor. A blocking means 90 that is designed to allow flow only in the direction of the intake line 22 or the air manifold 23 is situated in the partial purge line 442. If the downstream pressure at the blocking means 90 is greater than the upstream pressure or is greater than a predetermined pressure, the blocking means 90 automatically closes. The blocking means 90 in this case is illustrated as a check valve. The fuel vapor sorption system 40 also includes a diagnostic module 100 that is in fluid-conducting connection with the sorption agent container 41 via two lines. The diagnostic module 100 has an overpressure valve that is connected to the surroundings, and a pump (neither of which is illustrated). The diagnostic module 100 is used on the one hand for pressure compensation of the sorption agent container 41 and the fuel tank 60, and on the other hand for monitoring tank leaks.

In summary, the tank venting device 2 thus includes the following components: a fuel vapor sorption system 40 that is configured to reversibly store fuel vapor [in, and remove it] from, the fuel tank 60, a purge device 37, which is operable independently of the internal combustion engine 10, for applying a motive flow to the fuel vapor sorption system 40 in the direction opposite from the fuel tank 60, so that the fuel vapor sorption system 40 can be purged via a purge line 44, wherein the purge device 37 includes a control device 39 for controlling the motive flow, and includes a purge air pump 38.

Figure 2:
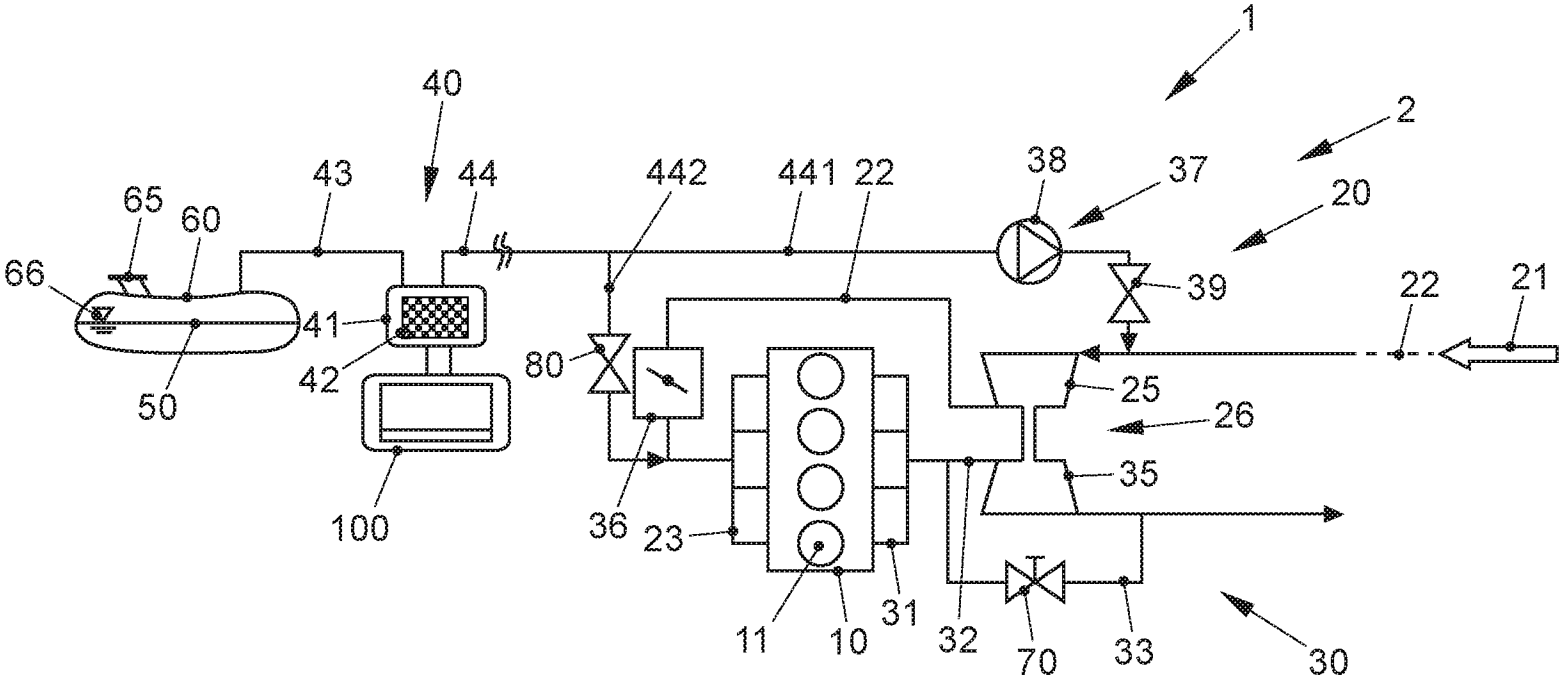
FIG. 2 shows another block diagram of a vehicle with a tank venting device according to one alternative embodiment of the invention.

FIG. 2 shows another block diagram of a vehicle 1 according to one alternative embodiment of the invention. The illustrated components and their positioning are essentially identical to the design shown in FIG. 1. Only the positioning of the tank vent valve 80 is illustrated differently.

In FIG. 2, the tank vent valve 80 instead of a blocking means is provided in the second partial purge line 442. In other words, the tank vent valve 80 is provided directly upstream from an inlet of the partial purge line 442 into the intake line 22. The introduction point is thus situated directly downstream from the tank vent valve 80, so that an additional check valve at this location is no longer necessary.

Figure 3:
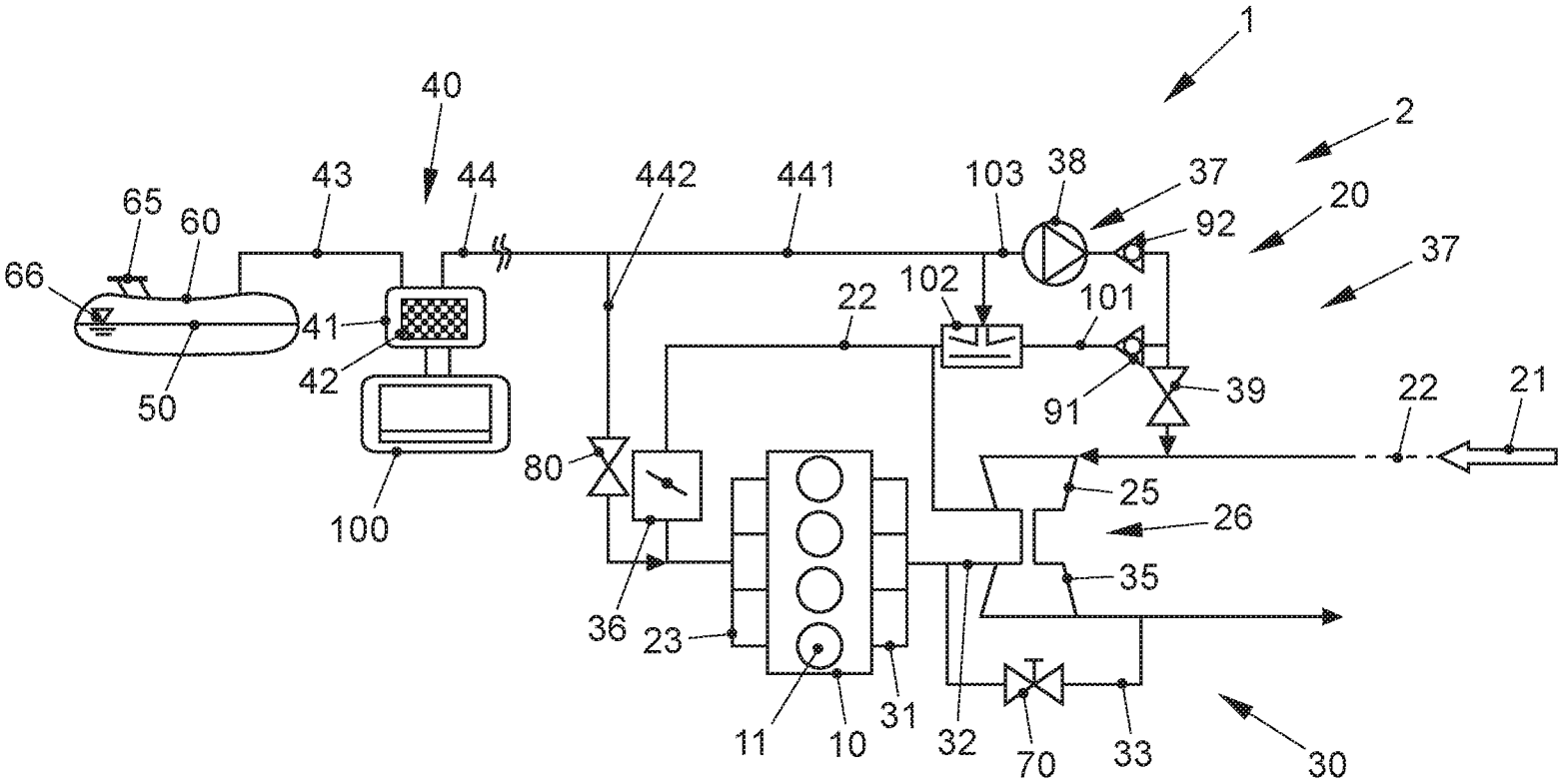
FIG. 3 shows another block diagram of a vehicle with a tank venting device according to one alternative embodiment of the invention.

FIG. 3 shows another block diagram of a vehicle 1 according to one alternative embodiment of the invention. The illustrated components and their positioning are essentially identical to the design shown in FIG. 1. Only the positioning of the tank vent valve 80 is illustrated differently.

In FIG. 3, the tank vent valve 80 instead of a blocking means is provided in the second partial purge line 442. In other words, the tank vent valve 80 is provided directly upstream from an inlet of the partial purge line 442 into the intake line 22. The introduction point is thus situated directly downstream from the tank vent valve 80, so that an additional check valve at this location is no longer necessary.

The air supply system 20 also has a return line 101 that branches off from the intake line 22 downstream from the compressor 25 and once again opens into the intake line 22 upstream from the compressor 25. A Venturi nozzle 102 is situated in the return line 101. In addition, a control device 39 is situated in front of the Venturi nozzle 102 and in the present example, downstream from the Venturi nozzle 102; in the present case, the control device is illustrated as a control valve. In addition, a blocking means 91 is provided between the Venturi nozzle 102 and the control device 39, and directly behind the Venturi nozzle 102. The blocking means 91 in this case is illustrated as a check valve. Parallel to the return line 101, a second return line 103 is apparent, which directly behind the blocking means 91 is combined with the return line 101, so that the control device 39 also acts on this return line 103. A purge device 37 is apparent in the return line 103. The purge device 37 includes an illustrated purge air pump 38 and a control device 39, which in this case is illustrated as a control valve. In addition, a further blocking means 92 is situated downstream from and directly behind the purge air pump 38, this blocking means 92 also being illustrated as a check valve.

In all FIGS. 1 through 3 shown, in addition to the description, directional arrows are illustrated at the appropriate locations which clarify the flow direction and the terms "upstream" and "downstream."

LIST OF REFERENCE NUMERALS

1 vehicle
2 tank venting device
10 internal combustion engine
11 cylinder
20 air supply system
21 combustion air
22 intake line
23 air manifold
25 compressor
26 exhaust gas turbocharger
30 exhaust gas system
31 exhaust manifold
32 exhaust duct
33 turbine bypass
35 turbine
36 throttle valve
37 purge device
38 purge air pump
39 control device
40 fuel vapor sorption system
41 sorption agent container
42 sorption agent
43 fuel vapor line
44 purge line
50 fuel
60 fuel tank
65 filler neck
66 level sensor
70 actuating means
80 tank vent valve
90 blocking means
91 blocking means
92 blocking means
100 diagnostic module
101 return line
102 Venturi nozzle
103 return line
441 first partial purge line
442 second partial purge line

The invention claimed is:

1. A tank venting device for a fuel tank that supplies an internal combustion engine with a fuel, the tank venting device comprising:

a fuel vapor sorption system that is configured for reversibly storing fuel vapor in, and removing it from, the fuel tank, and at least one purge device, which is operable independently of the internal combustion engine, for applying a motive flow to the fuel vapor sorption system in the direction opposite from the fuel tank, so that the fuel vapor sorption system can be purged via a purge line, wherein the purge device includes at least one control device including at least one control valve for regulating the motive flow through the purge line, wherein the control valve is a volume control valve configured to enable quantitative regulation of the motive flow through the purge line, wherein the fuel vapor sorption system includes at least one tank vent valve situated downstream from a sorption agent container and upstream from the purge device relative to the applied motive flow, wherein the purge device includes at least one purge air pump;

a first partial purge line and a second partial purge line, parallel to the first partial purge line, are downstream from the at least one tank vent valve, wherein the at least one purge air pump and the at least one control valve are situated in the first partial purge line; and wherein the at least one control valve is situated downstream from the purge air pump, relative to the applied motive flow.

2. The tank venting device according to claim 1, wherein the purge air pump is electrically and/or mechanically operable.

3. The tank venting device according to claim 1, wherein the fuel vapor sorption system further comprises a diagnostic module connected to the sorption agent container via two lines, wherein the diagnostic module includes a pump.

4. The tank venting device according to claim 1, wherein a check valve is situated in the second partial purge line.

5. The tank venting device according to claim 1, wherein the at least one control valve does not include a check valve.

6. A vehicle comprising:

an internal combustion engine that is operable with a fuel;

a fuel tank that is designed to supply the internal combustion engine with fuel; and a tank venting device comprising:

a fuel vapor sorption system that is configured for reversibly storing fuel vapor in, and removing it from, the fuel tank; and at least one purge device, which is operable independently of the internal combustion engine, for applying a motive flow to the fuel vapor sorption system in the direction opposite from the fuel tank, so that the fuel vapor sorption system can be purged via a purge line;

wherein the purge device includes at least one control device including at least one control valve for regulating the motive flow through the purge line, and the fuel vapor sorption system includes at least one tank vent valve situated downstream from a sorption agent container, wherein the purge device includes at least one purge air pump;

a first partial purge line and a second partial purge line, parallel to the first partial purge line, are downstream from the at least one tank vent valve;

wherein the at least one purge air pump and the at least one control valve are situated in the first partial purge line; and wherein the at least one control valve is situated downstream from the purge air pump, relative to the applied motive flow.

7. The vehicle according to claim 6, wherein the fuel vapor sorption system further comprises a diagnostic module connected to the sorption agent container via two lines, wherein the diagnostic module includes a pump.

8. The vehicle according to claim 6, further comprising a check valve situated in the second partial purge line.

9. The vehicle according to claim 6, wherein the at least one control valve does not include a check valve.

* * * * *